United States Patent [19]

Arkles

[11] Patent Number: 5,045,184

[45] Date of Patent: Sep. 3, 1991

[54] VIBRATING SCREEN PANEL

[76] Inventor: Basil R. Arkles, P.O. Box 843, Northlands 2116, South Africa

[21] Appl. No.: 448,928

[22] Filed: Dec. 12, 1989

[51] Int. Cl.[5] ..... B07B 1/46

[52] U.S. Cl. ..... 209/405; 209/399; 209/408; 335/219

[58] Field of Search ..... 209/368, 392, 397, 399, 209/405, 408, 409, 412; 335/219

[56] References Cited

U.S. PATENT DOCUMENTS 3,203,338 8/1965 Dry ..... 55/DIG. 31 X
3,495,710 2/1970 Bely et al. ..... 209/368

FOREIGN PATENT DOCUMENTS 1235555 6/1986 U.S.S.R. ..... 209/365.1
1433509 10/1988 U.S.S.R. ..... 209/399

*Primary Examiner*—Michael S. Huppert
*Assistant Examiner*—Edward M. Wacyra
*Attorney, Agent, or Firm*—Chilton, Alix & Van Kirk

[57] ABSTRACT

Modular screen panels are secured to the metal deck of a vibratory screening unit by magnets embedded in the panels. Locating holes for precise location of the panels are obviated since a plurality of magnets are mounted in the panels at suitably spaced positions, preferably adjacent the perimeter thereof.

7 Claims, 1 Drawing Sheet

FIG. 1
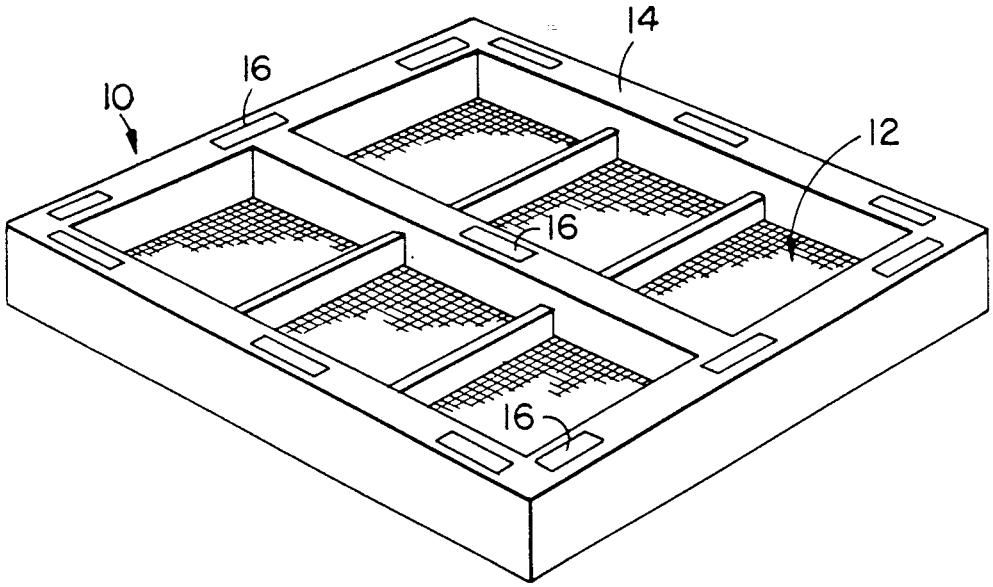
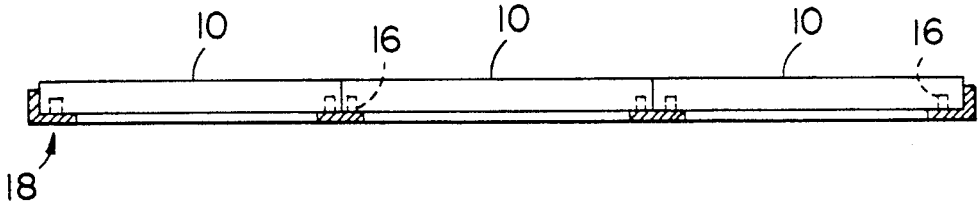
FIG. 2

VIBRATING SCREEN PANEL

FIELD OF THE INVENTION

This invention relates to modular screen panels which, in use, are releasibly located on the screen decks of vibratory screens.

BACKGROUND TO THE INVENTION

Modular screen panels for use on the screen decks of vibratory screens which are used for de-watering, size classification and generally washing, drain and rinse applications of particulate material are conventionally made from a wear resistant plastics material such as polyurethane with each panel on a screen deck including formations by means of which it is releasibly engageable with the frame of the screen deck. The formations on the panels are in the form of downwardly directed headed pegs which are either moulded to be integral with the panels or are loose components which are passed through holes in the panels or between adjacent panels on the deck to be press located in holes in the screen deck frame. One of the principle disadvantages to screen panels of the above type is that the screen deck which supports them needs to be accurately holed for precise location of the panels thus making the decks of machines of this type unnecessarily expensive.

OBJECT OF THE INVENTION

It is the object of this invention to provide a screen panel which is simple to locate on the screen deck of a machine which is to carry the panel.

SUMMARY OF THE INVENTION

A screen panel according to the invention includes a magnetic material by means of which the panel may be magnetically adhered to a screen frame which is made from a magnetic metal.

In a preferred form of the invention the magnetic material is in the form of a plurality of magnets which are attached, at suitably spaced positions, to the panel.

Further according to the invention the screen panel of the invention is moulded from a plastics material with the magnets being embedded in the material of the screen.

BRIEF DESCRIPTION OF THE DRAWINGS

The invention is now described by way of example only with reference to the drawings in which:

FIG. 1 is a perspective view of the underside of a modular screen panel according to the invention, and FIG. 2 is a partially schematic front elevation of a plurality of the FIG. 1 panels located on a screen deck.

DETAILED DESCRIPTION OF THE PREFERRED EMBODIMENT

The modular screen panel 10 of the invention is integrally moulded from a wear resistant plastics material such as polyurethane and is shown in FIG. 1 of the drawings to include, on its upper surface, a suitably apertured screen 12 which is supported on a frame 14. Rectangular bar magnets 16 are, during the moulding process, embedded in the material of the frame 14 to be exposed to the underside of the frame as shown in the drawing or to be located within the frame material just below the under surface of the elements of the frame 14. The magnets 16 need not necessarily be of the shape or number shown in FIG. 1 but could have any suitable shape or size and be attached in any suitable manner to the panel 10. Additionally, the sides of the panel frame could include magnets such as the magnets 16 shown in the drawing or the magnets 16 in the drawing could be located further outwardly on the frame elements than shown in the drawing so that adjacent panels in a screen deck would be magnetically attached to one another.

In use the screen panels of the invention are merely laid on a screen deck frame 18 as shown in FIG. 2 with the magnets 16 overlying and magnetically engaged with metal elements of the frame as shown in FIG. 2.

As will be appreciated from the above description the deck frame on which the screen panels of the invention are to be located need not be accurately holed or otherwise machined for accurate location of the panels 10 on the frame 18.

I claim:

1. A modular screen panel for a vibratory screen deck comprising frame means, screening means secured to said frame means and magnet means associated with said frame means and adapted for magnetically securing the modular panel to a magnetically responsive screen support immediately upon contact therebetween.

2. The modular panel of claim 1 wherein said magnet means is embedded in said panel.

3. The modular panel of claim 1 wherein the frame means and screening means are integrally formed.

4. The modular panel of claim 3 wherein the integral frame and screening means are molded as a single unit and the magnet means are embedded therein during the molding process.

5. The modular panel of claim 1 wherein the magnet means include a plurality of magnets spaced about the frame means.

6. The modular panel of claim 5 wherein at least one surface of one of the magnets is exposed.

7. A modular screen panel for a vibratory screen deck comprising frame means, screening means secured to said frame means and magnet means associated with said frame means and adapted for securing the modular panel to a magnetically responsive screen support, said magnet means being effective for securing together adjacent panels in an array on the vibratory screen deck.

* * * * *